US005210384A

United States Patent [19]

Shimozono et al.

[11] Patent Number: 5,210,384

[45] Date of Patent: May 11, 1993

[54] ACCELERATION SENSOR WITH MAGNETIC BIASED MASS AND ENCAPSULATED CONTACT TERMINALS AND RESISTOR

[75] Inventors: Shigeru Shimozono; Kazuo Yoshimura; Ryo Satoh, all of Kanagawa, Japan

[73] Assignee: Takata Corporation, Tokyo, Japan

[21] Appl. No.: 737,712

[22] Filed: Jul. 30, 1991

[30] Foreign Application Priority Data

Aug. 23, 1990 [JP] Japan ..... 2-221999

[51] Int. Cl.[5] ..... H01H 35/14

[52] U.S. Cl. ..... 200/61.45 M; 200/61.53

[58] Field of Search ..... 200/61.45 R-61.53

[56] References Cited

U.S. PATENT DOCUMENTS

| | | | |
|---|---|---|---|
| 4,168,410 | 9/1979 | Norris | 200/61.45 R |
| 4,221,940 | 9/1980 | Roth | 200/61.45 R |
| 4,827,091 | 5/1989 | Behr | 200/61.45 M |
| 4,873,401 | 10/1989 | Ireland | 200/61.45 M |
| 4,929,805 | 5/1990 | Otsubo | 200/61.45 R |
| 5,053,588 | 10/1991 | Bolender | 200/61.45 R |
| 5,123,499 | 6/1992 | Breed et al. | 200/61.45 M X |

*Primary Examiner*—J. R. Scott

*Attorney, Agent, or Firm*—Kanesaka and Takeuchi

[57] ABSTRACT

An accelerator sensor comprising a cylinder of a conductive material, a magnetized inertial member mounted in the cylinder so as to be movable longitudinally of the cylinder, a conductive member mounted at least on the end surface of the inertial member that is on the side of one longitudinal end of the cylinder, a pair of electrodes disposed at this one longitudinal end of the cylinder, and an attracting member disposed near the other longitudinal end of the cylinder. When the conductive member of the inertial member comes into contact with the electrodes, these electrodes are caused to conduct via the conductive member. The attracting member is made of a magnetic material such that the attracting member and the inertial member are magnetically attracted toward each other. An electrical resistor is bridged between the electrodes. The electrodes and the resistor are fabricated integrally out of a synthetic resin by insert molding.

1 Claim, 2 Drawing Sheets

ACCELERATION SENSOR WITH MAGNETIC BIASED MASS AND ENCAPSULATED CONTACT TERMINALS AND RESISTOR

FIELD OF THE INVENTION

The present invention relates to an acceleration sensor and, more particularly, to an acceleration sensor adapted to detect a large change in the speed of a vehicle caused by a collision or the like.

BACKGROUND OF THE INVENTION

An acceleration sensor of this kind is described in U.S. Pat. No. 4,827,091. This known sensor comprises a cylinder made of a conductive material, a magnetized inertial member mounted in the cylinder so as to be movable longitudinally of the cylinder, a conductive member mounted at least on the end surface of the inertial member which is on the side of one longitudinal end of the cylinder, a pair of electrodes disposed at this one longitudinal end of the cylinder, and an attracting member disposed near the other longitudinal end of the cylinder. When the conductive member of the magnetized inertial member makes contact with the electrodes, these electrodes are caused to conduct via the conductive member. The attracting member is made of such a magnetic material that the attracting member and the inertial member are magnetically attracted towards each other.

In this acceleration sensor, the magnetized inertial member and the attracting member attract each other. When no or almost no acceleration is applied to the sensor, the inertial member is at rest at the other end in the cylinder.

If a relatively large acceleration acts on this acceleration sensor, the magnetized inertial member moves against the attracting force of the attracting member. During the movement of the inertial member, an electrical current is induced in this cylinder, producing a magnetic force which biases the inertial member in the direction opposite to the direction of movement of the inertial member. Therefore, the magnetized inertial member is braked, so that the speed of the movement is reduced.

When the acceleration is less than a predetermined magnitude,or threshold value, the magnetized inertial member comes to a stop before it reaches the front end of the cylinder. Then, the inertial member is pulled back by the attracting force of the attracting member.

When the acceleration is greater than the predetermined magnitude, or the threshold value, e.g., the vehicle carrying this acceleration sensor collides with an object, the inertial member arrives at one end of the cylinder. At this time, the conductive layer on the front end surface of the inertial member makes contact with both electrodes to electrically connect them with each other. If a voltage has been previously applied between the electrodes, an electrical current flows when a short circuit occurs between them. This electrical current permits detection of collision of the vehicle.

The electrodes are electrically connected together by an electrical resistor having a high resistance in order to detect breakage of the lead wires running from the body of the collision-detecting circuit to the electrodes if such a breakage occurs. In particular, if a voltage is applied between the electrodes to detect a collision, a feeble electrical current flows through the electrical resistor. As long as this feeble current flows, the lead wires connecting the electrodes with the body of the circuit are judged to be free from breakage. If this feeble current ceases, it follows that either lead wire has broken.

In the prior art acceleration sensor, the aforementioned electrical resistor is located near the electrodes but is not spaced very close to the electrodes. Therefore, if any of the portions between the electrical resistor and the electrodes breaks, it is impossible to detect this breakage.

SUMMARY OF THE INVENTION

It is an object of the present invention to provide an acceleration sensor which ensures detection of breakage of lead wires extending from electrodes to the body of a collision-detecting circuit if any of the wires breaks.

It is another object of the invention to provide an acceleration sensor which has an electrical resistor not undergoing damage or deformation during assembly and in which electrodes and the electrical resistor are prevented from being corroded.

An acceleration sensor according to the invention comprises: a cylinder made of a conductive material; a magnetized inertial member mounted in the cylinder so as to be movable longitudinally of the cylinder; a conductive member mounted at least on the end surface of the inertial member which is on the side of one longitudinal end of the cylinder; a pair of electrodes which are disposed at this one longitudinal end of the cylinder and which, when the conductive member of the inertial member makes contact with the electrodes, are caused to conduct via the conductive member; and an attracting member disposed near the other longitudinal end of the cylinder and made of a magnetic material which magnetically attracts the inertial member. An electrical resistor is bridged between the electrodes. The electrodes and the electrical resistor are fabricated as an integrated unit with a synthetic resin by insert molding.

In this novel acceleration sensor, the electrical resistor can be placed in close proximity to the electrodes. This ensures that breakage occurring at a location very close to either electrode is detected. Furthermore, the electrodes and the electrical resistor are protected, because major portions of the electrodes and the electrical resistor are buried in the synthetic resin.

DETAILED DESCRIPTION OF THE INVENTION

Figure 1:
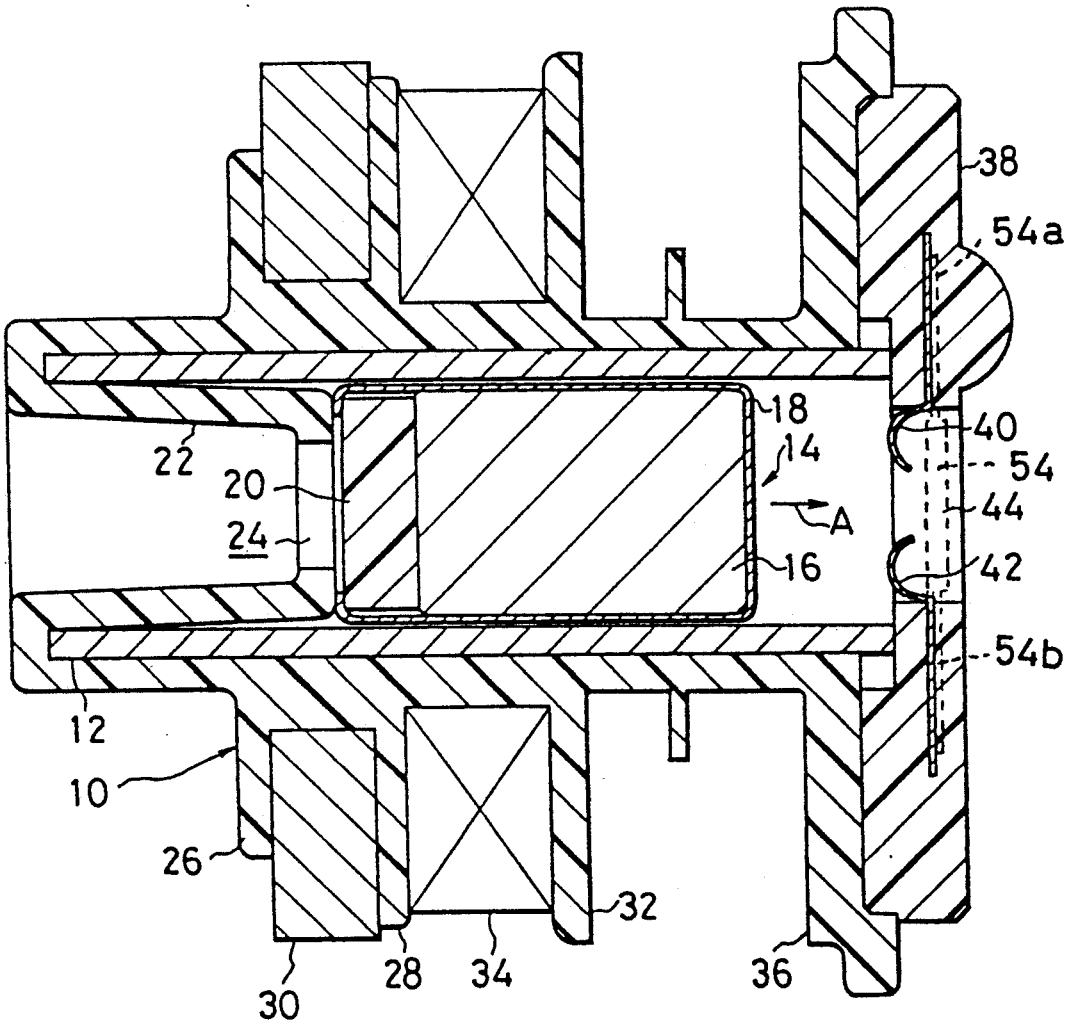
FIG. 1 is a cross-sectional view of an acceleration sensor according to the invention.

Referring to FIG. 1, there is shown an acceleration sensor according to the invention. This sensor has a cylindrical bobbin 10 made of a nonmagnetic material such as a synthetic resin. A cylinder 12 made of a copper alloy is held inside the bobbin 10. A magnetized inertial member or magnet assembly 14 is mounted in the cylinder 12. This assembly 14 comprises a cylindrical permanent magnet 16, a cylindrical case 18 having a bottom, and a packing 20 made of a synthetic resin. The case 18 is made of a nonmagnetic conductive material such as copper and encloses the magnet 16. The case 18 has no cover. The packing 20 acts to hold the magnet 16 within the case 18. The magnet assembly 14 is fitted in the cylinder 12 in such a way that it can move longitudinally of the cylinder 12.

The bobbin 10 has an insert portion 22 at its one end. This insert portion 22 enters the cylinder 12. An opening 24 is formed at the front end of the insert portion 22. A pair of flanges 26 and 28 protrude laterally from the front end of the insert portion 22 of the bobbin 10. An annular attracting member or return washer 30 which is made of a magnetic material such as iron is held between the flanges 26 and 28.

The bobbin 10 has another flange 32. A coil 34 is wound between the flanges 28 and 32. A further flange 36 is formed at the other end of the bobbin 10. A contact holder 38 is mounted to this flange 36.

This contact holder 38 is made of a synthetic resin. A pair of electrodes 40 and 42 are buried in the holder 38. An opening 44 is formed in the center of the holder 38. The front ends of the electrodes 40 and 42 protrude into the opening 44. The electrodes 40 and 42 have arc-shaped front end portions. Parts of the arc-shaped front end portions are substantially flush with the front end surface of the cylinder 12.

Figure 2:
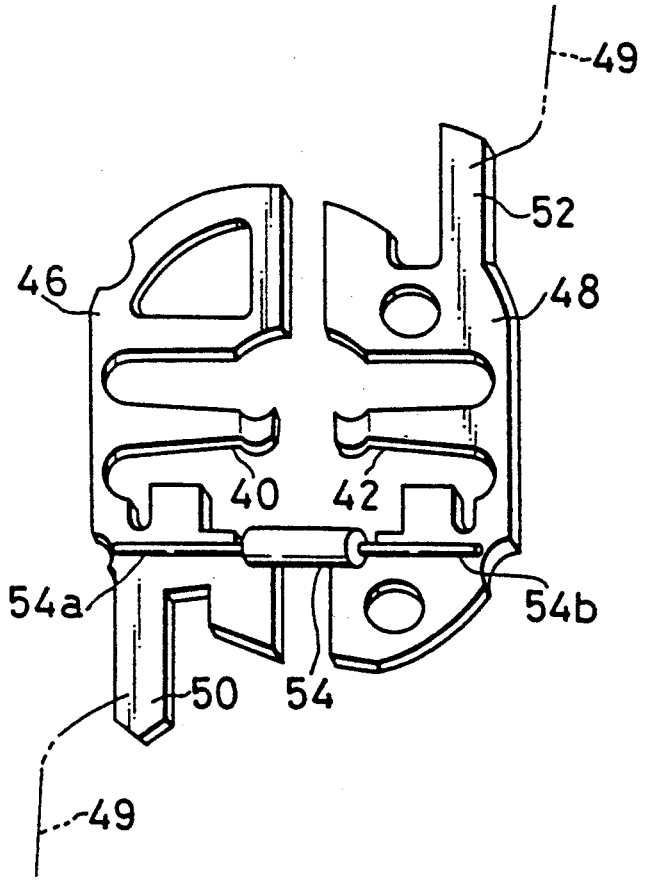
FIG. 2 is a perspective view of electrodes and an electrical resistor which are used in the sensor shown in FIG. 1.

FIG. 2 is a perspective view showing the electrodes 40 and 42. These electrodes 40 and 42 are formed as parts of conductive pieces 46 and 48, respectively, which are stamped from sheet copper. The conductive pieces 46 and 48 have terminals 50 and 52, respectively, with which lead wires 49 are connected. An electrical resistor 54 is bridged between the conductive pieces 46 and 48 which have lead electrodes **54*a* and 54*b*, respectively. The lead electrodes 54*a* and 54*b* are soldered or otherwise joined to the conductive pieces 46 and 48**, respectively.

The conductive pieces 46 and 48 which are connected together by the electrical resistor 54 are insert-molded out of a synthetic resin together with the resistor 54. The resistor 54 and main portions of the conductive pieces 46, 48 are buried in the contact holder 38 shown in FIG. 1.

The operation of the acceleration sensor constructed as described thus far is now described. When no external force is applied, the magnet assembly 14 and the return washer 30 attract each other. Under this condition, the rear end of the magnet assembly 14 is in the illustrated rearmost position where it bears against the front end surface of the insert portion 22. If an external force acts in the direction indicated by the arrow A, then the magnet assembly 14 moves in the direction indicated by the arrow A against the attracting force of the return washer 30. This movement induces an electrical current in the cylinder 12 made of a copper alloy, thus producing a magnetic field. This magnetic field applies a magnetic force to the magnet assembly 14 in the direction opposite to the direction of movement. As a result, the magnet assembly 14 is braked.

Where the external force applied to the acceleration sensor is small, the magnet assembly 14 comes to a stop on its way to one end of the cylinder 12. The magnet assembly 14 will soon be returned to its rearmost position shown in FIG. 1 by the attracting force acting between the return washer 30 and the magnet assembly 14.

If a large external force is applied in the direction indicated by the arrow A when the vehicle collides, then the magnet assembly 14 is advanced up to the front end of the cylinder 12 and comes into contact with the electrodes 40 and 42. At this time, the case 18 of the magnet assembly 14 which is made of a conductive material creates a short-circuit between the electrodes 40 and 42, thus producing an electrical current between them. This permits detection of an acceleration change greater than the intended threshold value. Consequently, the collision of the vehicle is detected.

The aforementioned coil 34 is used to check the operation of the acceleration sensor. In particular, when the coil 34 is electrically energized, it produces a magnetic field which biases the magnet assembly 14 in the direction indicated by the arrow A. The magnet assembly 14 then advances up to the front end of the cylinder 12, short-circuiting the electrodes 40 and 42. In this way, the coil 34 is energized to urge the magnet assembly 14 to move. Thus, it is possible to make a check to see if the magnet assembly 14 can move back and forth without trouble and if the electrodes 40 and 42 can be short-circuited.

In the present example, the lead electrodes **54*a* and 54*b* of the electrical resistor 54 are joined to the conductive pieces 46 and 48, respectively, as described above. Therefore, if either lead wire breaks anywhere along its whole length running from the conductive piece 46 or 48 to the body (not shown) of the collision-detecting circuit, it can be detected. Since the main portions of the conductive pieces 46 and 48 and the electrical resistor 54 are buried in the contact holder 38 made of a synthetic resin, the conductive pieces 46, 48 and the resistor 54 can be protected. Specifically, when the acceleration sensor is assembled, neither the worker's hand nor the tool used for the assembly operation makes direct contact with the conductive pieces 46, 48 or with the resistor 54. Consequently, these components are protected from being deformed or damaged. Also, the conductive pieces 46, 48 and the electrical resistor 54** are protected from being corroded.

As described thus far, in the novel acceleration sensor, the electrical resistor is bridged between the electrodes with which the magnetized inertial member is contacted. This assures that if either lead wire running from one electrode to the body of the collision-detecting circuit breaks, it can be detected. Furthermore, during the assembly of the sensor, the electrodes and the electrical resistor are protected from being damaged or deformed, because main portions of the electrodes and the resistor are buried in the synthetic resin. Also, the electrodes and the electrical resistor are protected against corrosion.

What is claimed is:

1. An acceleration sensor comprising:

a cylinder made of a conductive material and having first and second longitudinal ends;

a magnetized inertial member slidably mounted in the cylinder so as to be movable in the longitudinal direction of the cylinder;

a conductive member fixed at least on an end surface of the inertial member facing the first longitudinal end of the cylinder;

a pair of electrodes fixed relative to the cylinder at said first longitudinal end of the cylinder, said electrodes, when the conductive member of the inertial member makes contact with the electrodes, being caused to conduct via the conductive member, said electrodes being formed as parts of conductive pieces having terminals adapted to be connected to lead wires and stamped from sheet copper;

an attracting member fixed relative to the cylinder near the second longitudinal end of the cylinder and made of a magnetic material, said attracting member magnetically attracting the inertial member;

an electrical resistor directly bridging between the electrodes, said resistor having a body and a pair of lead electrodes extending from the body, said lead electrodes being joined to said conductive pieces; and a synthetic resin for enclosing said electrodes and said electrical resistor integrally, said electrodes and said electrical resistor being buried in the synthetic resin by insert molding so that the electrodes and the resistor are protected from being damaged.

* * * * *